US005314371A

United States Patent [19]

Mason

[11] Patent Number: 5,314,371

[45] Date of Patent: May 24, 1994

[54] TOY WEAPON SIMULATOR FOR STRESS REDUCTION

[76] Inventor: Kirk D. Mason, 2304 Cumberland Cir., #215, Clearwater, Fla. 34623

[21] Appl. No.: 100,315

[22] Filed: Aug. 2, 1993

[51] Int. Cl.[5] ..... A63H 5/00; A63H 33/26

[52] U.S. Cl. ..... 446/397; 446/485

[58] Field of Search ..... 446/397, 485, 405, 473; 472/57

[56] References Cited

U.S. PATENT DOCUMENTS 3,394,491 7/1968 Valentine ..... 446/397 X 4,175,353 11/1979 Pickett ..... 446/406

*Primary Examiner*—Mickey Yu

*Attorney, Agent, or Firm*—Stanley M. Miller

[57] ABSTRACT

A toy for mounting on the dashboard of a vehicle in front of the driver. The toy includes a box-like housing that houses a plurality of tone generators. Each tone generator, when activated, produces the sounds of a military assault weapon, and a selector switch is provided for each tone generator so that the driver of the vehicle may select the desired sound. A firing button is provided so that after the desired tone generator has been activated, pressing the firing button causes the selected sound to be generated. The sounds may be broadcast over a built-in speaker, or over the vehicle's speaker system. LED lights in the top wall of the housing are reflected onto the windshield of the vehicle, and form a simulated target sight. Thus, a driver desiring to vent frustrations may simulate shooting at a fanciful enemy driver by activating the device, activating a selected tone generator, aligning the other vehicle in the target sight, and pressing a firing button to cause generation of the selected sound.

11 Claims, 1 Drawing Sheet

TOY WEAPON SIMULATOR FOR STRESS REDUCTION

BACKGROUND OF THE INVENTION

1. Field of the Invention

This invention relates, generally, to toys. More particularly, it relates to a toy mountable on the dashboard of a vehicle to reduce the stress and frustration experienced by the vehicle's operator.

2. Description of the Prior Art

Electronic synthesizers for producing sounds of all types are well known. These devices can simulate virtually all sounds, from violins to machine gun fire. Multiple types of sounds can be stored in a single device, and a sound may be selected by pressing a selector switch actuator.

Hand-held joysticks for interacting with computer games are also well known. A player can cause computer-generated characters to jump, run, fire a weapon, and the like upon pressing a button on the joystick. An appropriate sound may also be generated by the computer to correspond to the action of the character, i.e., a "boing" may sound when the player causes the character to jump, or an explosive sound may be heard when the player causes a character to fire a weapon, and so on.

Light-emitting diodes are also well known. Typically, they emit red light and are commonly used to indicate that a circuit has been turned on, that power is being supplied to a circuit, and the like.

It is also well known that drivers of automobiles often become angry with other drivers who behave rudely on the highways. Sometimes the offended driver becomes angry but does nothing, thereby driving up his or her blood pressure and otherwise harming his or her health. Sometimes the offended driver will waive a fist or gesture obscenely at the other driver; this behavior sometimes causes an escalation of the tension between the drivers, and in some cases leads to the drivers leaving their respective vehicles and commencing active hostilities.

The problem of traffic-related violence and the technology of electronic sound synthesizers, joysticks, and light-emitting diodes have never been related to one another. Thus, at the time the present invention was made, it was not obvious to those of ordinary skill in the divergent arts of electronics and social science how technology could be used to reduce stress on the highways.

SUMMARY OF THE INVENTION

The present invention is based upon the insight that a motorist, made angry by a rude or careless driver, might wish momentarily that a weapon were available to blast that driver from the highway. People who do not have criminal minds may have such thoughts but will not dwell upon them and will not take any overt action to carry out their fantasy. People with a humorous outlook will sometimes pretend they are combat-trained jet fighter pilots, and that the offending driver is piloting an enemy craft that must be downed to save mankind. These humorists will imagine that they are engaged in mortal combat, dogfighting down the highway with the foe. They capture the offending driver's car in their imaginary gunsights, and heroically blast the offender out of the skies. In other scenarios, the humorist may imagine he is a fearless tank commander, roaring across the desert in pursuit of a ruthless enemy tank, and so on.

This invention enables the fantasy of the humorist to be played out in a safe manner. More importantly, it encourages people who are not normally in a humorous mood to become more humorous in their attitude about the problems of daily life, such as traffic problems. Just as importantly, it enables its user to respond to a perceived traffic-related insult or challenge in a way that prevents an increase in the user's blood pressure and in a way that ensures that tensions between drivers will not escalate.

A small box is mounted on the dashboard of a vehicle, directly in front of the steering wheel. It houses a plurality of tone generators, and an equal-numbered plurality of selector switch actuators are mounted on the front panel of the box so that the driver can select a sound from said plurality of available sounds. A joystick is electrically connected to the box and may be mounted on the dashboard, on a gear shift stick, or any other location desired by its owner; it may even be unmounted and left lying on a seat to be picked up and held by the driver whenever needed. The selector switch and the joystick are electrically connected in a logical AND arrangement, i.e., in series, so that to produce a sound, both the selector switch actuator and the button on the joystick must be pressed. Thus, the driver first selects a sound by pressing the appropriate selector switch actuator, and then causes activation of the tone generator that produces that sound by depressing the joystick button. The sound begins with the pressing of the joystick button and ends when the joystick button is released. This gives the driver a sense of control over the firing of an important-sounding weapon at his imaginary adversary, and serves to reduce stress.

An even more delightful feature of the present invention is yet to be disclosed. The present invention not only gives a driver the satisfying feeling of shooting in an imaginary fashion at a rude motorist, it even produces a sophisticated-looking target sight for lining up the offending motorist before firing the imaginary missiles or cannons that will teach the offending motorist not to behave so rudely in the future. This amazing effect is accomplished by a highly novel use of light-emitting diodes (LEDs). A plurality of elongate, narrow slots are formed in the top wall of the housing for the invention, and elongate, narrow LEDs are placed just below those slots. The LEDs are activated by throwing a switch; the red light they generate is cast onto the windshield directly thereabove, in the line of sight of the driver. Due to their elongate, narrow shape, and the preselected layout of the slots, such light will produce a pattern looking very much like the target sight of a jet fighter, a tank, or other sophisticated combat weapon. The vision of the driver will not be impaired because the pattern is merely a transparent or translucent reflection of red light onto the windshield. However, the reflection will be strong enough to convey to the driver that he or she is commanding a sophisticated combat weapon and that the target sight has been activated. Thus, if the offending driver cuts in front of the driver armed with this new weapon, instead of yelling angrily at the offender or sounding one's horn and waving one's fist, the offended driver calmly goes into action, just as would a cool combat veteran. He or she professionally arms his or her weapon by throwing the main power switch actuator that activates all weapon system components, including the LEDs that cast the target site onto the windshield; next, a selector switch actuator is thrown to select the form of weapon to be used in the attack. The joystick is then grasped, and when the offending vehicle appears in the target sight on the windshield, the joystick button is depressed. The sounds of cannons, heavy artillery, laser weaponry, and the like then fill the air as the offending driver receives his or her just desserts. This delights the weapon systems operator and gives vent to frustration; importantly, the driver of the destroyed enemy vehicle never knows it was under attack so the tensions between the two drivers do not escalate. Just as importantly, after experiencing the humorous effects of the preparations for combat and the equally humorous effects of the sounds made by the bombs and missiles as they were fired, the offended driver is much more relaxed and will not experience the health-threatening effects that an angry fit would have entailed.

In lieu of a joystick, the driver may instead elect to depress a firing switch actuator built into the housing.

Thus, it is clear that the primary object of this invention is to provide a means for reducing stress in vehicle operators.

A closely related object is to provide a means that reduces the probability of a traffic incident escalating into violence between the drivers of vehicles involved in the incident.

Still another object is to provide a humorous toy that will be enjoyed even by those who are not normally of the humorous disposition, thereby encouraging them to become more humorous not only in their attitudes about traffic problems but in other areas of life as well.

These and many other important objects, features, and advantages of the invention will become more clear as this description of the invention proceeds.

The invention accordingly comprises the features of construction, arrangement of parts, and combination of elements hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the appended drawings, in which.

DETAILED DESCRIPTION OF THE PREFERRED EMBODIMENT

Figure 1:
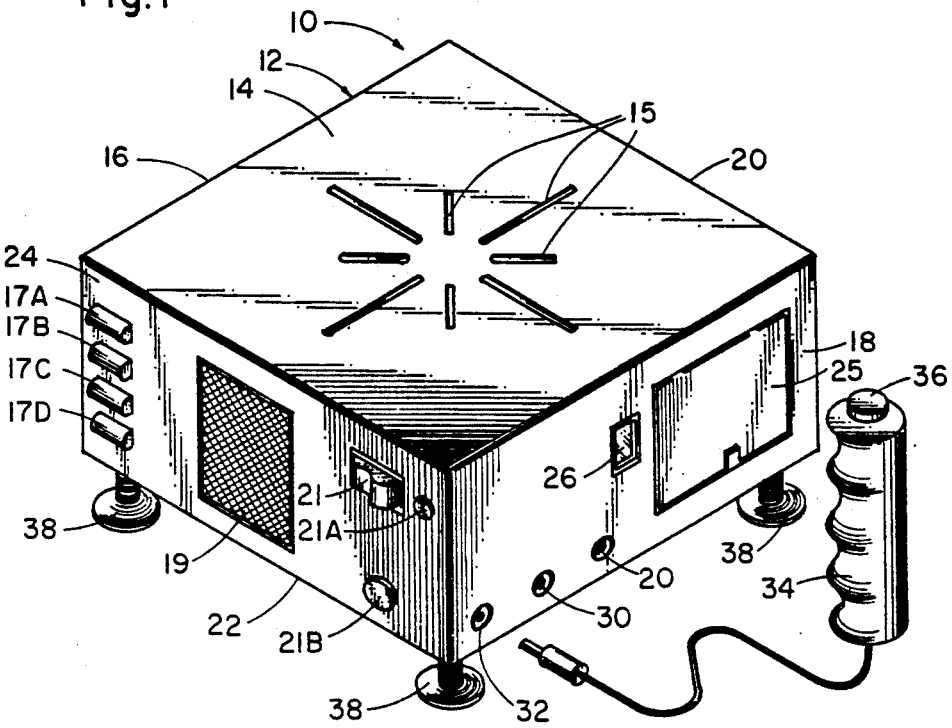
FIG. 1 is an isometric perspective view of the invention.

Referring now to FIG. 1, it will there be seen that an illustrative embodiment of the invention is denoted as a whole by the reference numeral 10.

In this embodiment, device 10 includes a housing 12 of parallelepiped construction; it includes a top wall 14, side panels 16 and 18, a back panel 20, a bottom wall 22, and a front panel 24.

Figure 2:
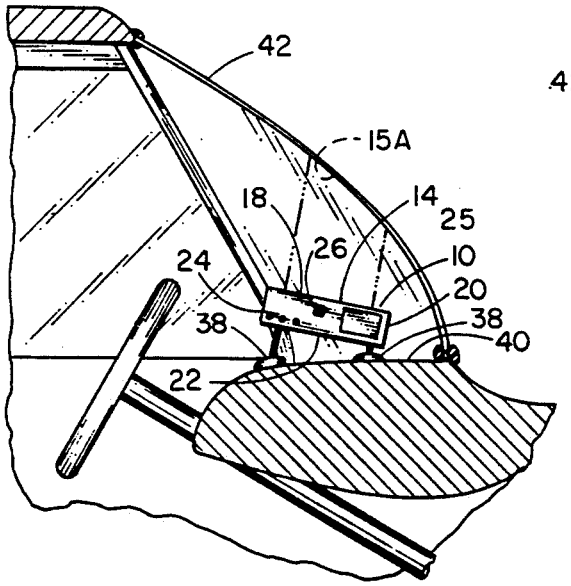
FIG. 2 is a side elevational view, partially in cross section, depicting the novel device on the dashboard of a vehicle.
Figure 3:
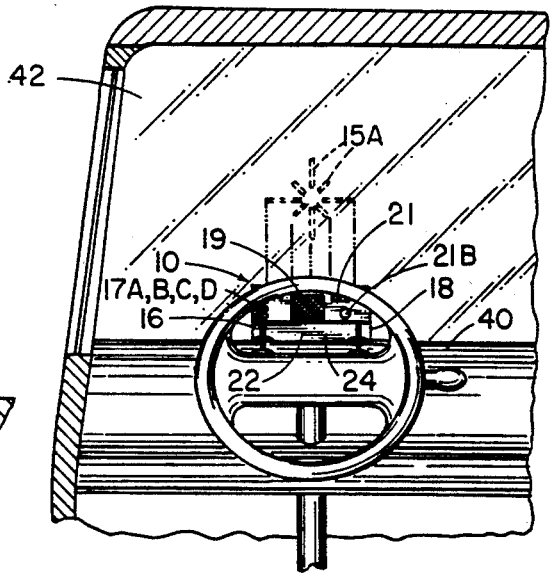
FIG. 3 is a front elevational view of the device as viewed by the driver of the vehicle within which it is mounted.

A plurality of elongate, narrow slots, collectively denoted 15, are formed in top panel 14 in a predetermined array as shown. LEDs, also indicated by reference numeral 15, are positioned therebelow in association therewith and, when activated, cast a red light through said slots. FIGS. 2 and 3 show how the light is directed upwardly onto the windshield of the vehicle; note the target sight appearance of said lights when reflected onto the windshield as depicted in FIG. 3 and denoted 15A therein.

A plurality of selector switch actuators, denoted 17A, 17B, 17C, and 17D, are mounted on front panel 24 as shown in FIGS. 1 and 3. Preferably, they are LED-type selector switch actuators. Each switch, when actuated, activates a different tone generator; thus, a multitude of different sounds are available to the user of device 10; only four selector switch actuators are shown but any number thereof, including only one, is within the scope of this invention. Importantly, activation of a selector switch actuator does not produce a sound; it merely arms a tone generator.

A speaker and protective grille 19 are also mounted on front panel 24, and the sounds produced by the tone generators when they are armed and activated is emitted through said speaker for the delight of the occupants of the vehicle equipped with this novel device. However, the driver who wants a fuller sound may connect the electrical output signals of the tone generators to the sound system of the vehicle; external speakers are of course contraindicated because such would alarm the driver of the attacked vehicle and might lead to the violence sought to be mitigated by the present invention.

On-off switch actuator 21 and a power-on indicator lamp 21A are also mounted on front panel 24. This is the switch actuator the driver throws to arm his or her weapons system when an incident occurs and the need for combat becomes apparent. When the weapons system is armed by throwing switch actuator 21, lamp 21A comes on as a grim reminder that combat is imminent. Simultaneously, the LEDs associated with slots 15 cast their reflection on the windshield, thereby heightening the sense of drama. The driver next selects the weapons system to be used by depressing one of the selector actuator switches 17A–17D.

Firing button 21B, also on front panel 24, may then be pressed to activate the tone generators and to produce the sounds of a military assault. The use of the target sight on the windshield is optional, because if the enemy craft cannot be lined up in said target sight, heat-seeking, wire-guided, or pre-programmed missiles can still be relied upon to avenge the misdeeds of the offending driver.

A battery access door 25 is formed in side panel 18, but the use of batteries to power the novel weapon systems simulator is optional. Electrical socket 26 is also provided on side panel 24 so that electrical power can be delivered to the housing 10 from the vehicle's cigarette lighter or other suitable source of power, in lieu of batteries. Jack 28 in side panel 18 enables the unit to be connected to the vehicle's sound system, and jack 30 enables the driver to hear the sounds of combat through earphones so as not to disturb sleeping infants in the vehicle or the like. Jack 32 enables optional connection of a joystick 34 having a firing button 36; as mentioned earlier, the joystick can be left unmounted to provide the driver with greater freedom of movement when using the joystick, or it may be mounted at a fixed location to perhaps better simulate the firing mechanism of a real combat vehicle.

Legs 38 support the housing 12 on dashboard 40; importantly, they are adjustable in length so that the position of the target sight 15A on windshield 42 may be adjusted to the driver's preference. For example, if the target sight is too low on the windshield, decreasing the length of the front legs will raise the location of the reflected image 15A, as should be understood from an inspection of FIG. 2.

Clearly, this invention provides the world's first weapons simulator for use by motorists. It provides harmless fun for its users and benefits society by reducing tensions of the highway.

This invention is clearly new and useful. Moreover, it was not obvious to those of ordinary skill in this art at the time it was made, in view of the prior art considered as a whole.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A toy for mounting upon the dashboard of a vehicle to reduce the stress of the driver of the vehicle when rude or offensive operator of other vehicles are encountered, comprising:

a housing of predetermined geometrical configuration;

a power switch actuator for connecting a power source to said housing;

at least one tone generator disposed within said housing;

a speaker means in electrical communication with said at least one tone generator;

a least one tone generator actuator switch for actuating said at least one tone generator;

a firing switch in electrical communication with said at least one tone generator actuator switch so that a predetermined sound is generated by said at least one tone generator only when the power switch actuator has been throw, said at least one tone generator switch actuator has been thrown, and said firing switch has been thrown;

said housing having a top wall;

a plurality of elongate slots formed in said top wall;

a plurality of light-emitting means disposed within said housing, there being one light-emitting means associated with each of said elongate slots in closely spaced relation therebelow so that light emitted by said light-emitting means is cast through said elongate slots;

each of said light-emitting means being in electrical communication with said power switch actuator so that activation of said power switch activates each of said light-emitting means; and said housing adapted to be mounted atop said dashboard so that light emitted through said elongate slots is projected onto the windshield of the vehicle to thereby simulate the presence of a target sight;

whereby a driver of a vehicle may engage the driver of another vehicle in imaginary combat by causing said device to emit preselected sounds.

2. The toy of claim 1, wherein said firing switch actuator is mounted on said housing.

3. The toy of claim 1, wherein said firing switch actuator is mounted on a joystick that is remote from said housing, and wherein said housing includes an electrical jack for connection of said joystick to said housing.

4. The toy of claim 1, wherein said housing further includes an electrical jack for receiving headphones so that sound emitted by said at least one tone generator is heard only by an individual wearing headphones.

5. The toy of claim 1, wherein said housing further includes an electrical jack for connection of an external source of power to said housing.

6. The toy of claim 1, wherein said housing further includes an electrical jack for the connection thereto of external speakers.

7. The toy of claim 1, further comprising a plurality of leg members for supporting said housing on said dashboard, each of said leg members being adjustable in height so that the angle of said top wall and hence the angle of reflection of said light from said light-emitting means may be adjusted so that the simulated target sight is placed on said windshield at a height selected by the driver of the vehicle.

8. The toy of claim 1, further comprising an indicator light associated with said power switch actuator to indicate whether or not power is being supplied to said housing.

9. The toy of claim 1, wherein said housing further includes a front panel, and wherein said at least one tone generator switch actuator and said power switch actuator are positioned on said front panel for the convenience of the driver.

10. The toy of claim 2, wherein the firing switch actuator is mounted on a front panel of said housing.

11. The toy of claim 1, wherein a speaker means is mounted on a front panel of said housing.

* * * * *